US007533940B1

(12) United States Patent
Zook

(10) Patent No.: US 7,533,940 B1
(45) Date of Patent: May 19, 2009

(54) CONVERTIBLE STORAGE BOX ASSEMBLY

(76) Inventor: Jimmy D. Zook, 1734 Cape Coral Pkwy., Cape Coral, FL (US) 33904

( * ) Notice: Subject to any disclaimer, the term of this patent is extended or adjusted under 35 U.S.C. 154(b) by 79 days.

(21) Appl. No.: 11/799,709

(22) Filed: May 1, 2007

(51) Int. Cl.
*A47B 85/04* (2006.01)
*A47B 39/00* (2006.01)
*A47B 83/02* (2006.01)
*A47B 47/00* (2006.01)

(52) U.S. Cl. ..... 297/440.13; 297/119; 297/140; 108/11; 108/14; 108/180; 312/240; 312/241

(58) Field of Classification Search ..... 297/440.13, 297/119, 140; 108/11, 14, 15, 17; 312/240, 312/241
See application file for complete search history.

(56) References Cited

U.S. PATENT DOCUMENTS

D154,453 S * 7/1949 Schukat ..... 297/140 X
D159,534 S * 8/1950 Raichert ..... 297/140 X
2,524,198 A * 10/1950 La Rue ..... 297/139
D165,554 S * 12/1951 Schukat ..... 297/140 X
2,614,018 A * 10/1952 Engel ..... 297/140 X
2,661,792 A * 12/1953 Lysaght ..... 297/440.13 X
3,300,245 A * 1/1967 Rumble ..... 297/440.13 X
3,301,590 A * 1/1967 Young ..... 297/140 X
3,788,700 A * 1/1974 Wartes ..... 297/440.13
3,861,327 A * 1/1975 Silson ..... 108/91
4,223,945 A * 9/1980 Nikitits ..... 297/158.4
4,509,794 A * 4/1985 Roland ..... 297/440.13
4,834,450 A * 5/1989 Stickler ..... 297/440.13 X
4,867,327 A * 9/1989 Roland ..... 217/12 R
5,251,955 A * 10/1993 Sarafa ..... 297/158.5
5,367,964 A * 11/1994 Hockensmith ..... 108/180
5,454,331 A * 10/1995 Green ..... 108/180
6,068,331 A * 5/2000 Barnes ..... 297/440.13 X
6,155,641 A * 12/2000 Frost ..... 297/344.12
7,156,273 B2 * 1/2007 Morris ..... 108/41 X
2003/0107254 A1 * 6/2003 Willy ..... 297/440.13
2003/0107255 A1 * 6/2003 Willy ..... 297/440.13
2004/0056526 A1 * 3/2004 Willy ..... 297/440.13
2005/0253424 A1 * 11/2005 Thomas et al. ..... 297/119

* cited by examiner

*Primary Examiner*—Rodney B White
(74) *Attorney, Agent, or Firm*—William E. Noonan

(57) ABSTRACT

A convertible multiple panel assembly includes a plurality of panels that carry complementary releasable interlocking components. The components are selectively interengagable in a first pattern such that the panels define a box. The components are selectively disengaged from one another and re-interengaged in an alternative, second pattern to define a table and at least one associated bench.

16 Claims, 8 Drawing Sheets

CONVERTIBLE STORAGE BOX ASSEMBLY

FIELD OF THE INVENTION

This invention relates to a convertible storage box assembly and, more particularly, to a box comprising parts that may be disassembled and re-assembled to form a table and benches.

BACKGROUND OF THE INVENTION

Camping trips frequently require the use of a considerable amount of gear, which must be stored, organized and transported to the campsite. Rather than loosely piling such gear in the back or trunk of a vehicle, it is usually more efficient and convenient to stow the camping gear in a storage container that fits neatly in the vehicle.

Although some campsites feature picnic tables or the like, many remote locations, such as wilderness sites, do not. In many cases, a table and benches provide for a more pleasant and convenient camping experience. Campers are able to sit down comfortably for meals or to perform other tasks. Typically, however, it is not practical or convenient to transport a picnic table or other type of table to a remote campsite. Such tables are usually large and bulky and do not fit easily within a vehicle. Space is particularly limited when the vehicle is crammed with other camping gear.

SUMMARY OF THE INVENTION

It is therefore an object of the present invention to provide a rugged and efficient assembly that may be quickly and effectively converted from a storage box to a table and benches.

It is a further object of this invention to provide an assembly that features reliable effective, and easy to use interlocking connections that permit the assembly to be quickly and conveniently converted from a storage box to a table and benches, and vice versa, without requiring tools or strenuous effort.

It is a further object of this invention to provide a convertible assembly that may be conveniently and efficiently transported to a camping site or other remote location in virtually any type of vehicle.

It is a further object of this invention to provide a convertible assembly that saves considerable vehicle space.

It is a further object of this invention to provide a convertible assembly that may be assembled to serve as a storage box for camping gear or other items during transit and which may then be quickly and conveniently disassembled and re-assembled into a table and benches for use at a campsite.

It is a further object of this invention to provide a convertible assembly that provides the user with a portable table and benches at remote locations that are otherwise lacking such items and, which may be conveniently collapsed and re-assembled to form a storage box during transit to and from the remote location.

It is a further object of this invention to provide a convertible assembly that is particularly effective for use in camping applications and which serves as either a storage box for efficiently and neatly organizing gear or a table and benches that may be utilized at the camping site.

This invention results from a realization that camping efficiency and convenience may be improved considerably by providing an assembly that converts between a storage box and a table and assorted benches. The box organizes and stores camping gear during travel to and from a campsite. A series of complementary interlocking components allow the parts of the box to be quickly and conveniently disassembled and re-assembled to convert the assembly from a storage box to a table and associated benches, which may be used conveniently at the campsite.

This invention features a convertible, multiple panel assembly including a plurality of panels that carry complementary, releasable interlocking components. The interlocking components are selectively interengagable in a first pattern such that the panels define a box. The interlocking components are selectively disengaged from one another and re-interengaged in an alternate, second pattern to define a table and at least one associated bench.

In a preferred embodiment, the assembly is convertible between a storage box and a table and associated pair of benches. The assembly may include a first panel for selectively forming a bottom of the box and a top of the table. A pair of like second panels may selectively form respective ends of the box and respective ends of the table. A pair of like third panels may selectively form an interior box divider and respective bench seat supports. A pair of like fourth panels may selectively form respective sides of the box and respective table supports. A pair of like fifth panels may selectively form respective lids of the box and respective bench seats. Four like sixth panels may selectively form respective bench ends. The panels typically carry a plurality of releasable locking components that are selectively interengagable in either the first pattern or the second pattern to construct a selected one of the assemblies.

The releasable locking components may include tabs attached to at least some of the panels and complementary tab slots formed in at least some of the other panels for selectively receiving the tabs. At least one of the tabs may include a pin slot for receiving a locking pin therein when the tab is received by a complementary tab slot. This locks the tab in the tab slot.

The releasable locking components may include a pin attached unitarily to at least one of the panels and a complementary pin receptacle formed in another one of the panels for receiving the pin. The releasable locking components may also include a hook attached unitarily to one of the panels and a complementary notch formed in another one of the panels for selectively interengaging the hook.

The first panel may have a first pair of tabs attached to a first end thereof and a second pair of tabs attached to an opposite end thereof. The first panel may have a pair of tab slots formed along respective sides thereof, which sides interconnect the opposing ends. The first panel may further include a first pair of pins attached unitarily to a first end thereof and a second pair of pins attached unitarily to the opposite end thereof.

The second panel may include a pair of tabs attached to one side thereof. The second panel may include a pair of opposing ends and a pair of opposing elongate sides that interconnect the opposing ends. In such cases, the second panel may further include a first plurality of elongate tab slots that extend longitudinally between the ends of the second panel and a second plurality of elongate tab slots that extend longitudinally between the sides of the second panel. The second panel may feature three pin receptacles, two for respectively receiving respective an associated pin carried by the first panel and the other pin receptacle for selectively receiving a pin carried by one of the third panels. The second panel may also include a notch for being selectively interengaged by a hook attached to a respective third panel.

The third panel may include a pair of pins attached to respective ends thereof for being selectively interengaged with respective pin receptacles formed in the second panels and in the sixth panels. The fourth panel may include of opposing ends and a pair of opposing elongate sides that interconnect the ends. The fourth panel preferably carries at least one tab on each end thereof and at least one tab on one of the sides thereof.

The fifth panel may include a pair of opposing ends and a pair of opposing elongate sides that interconnect the ends. The fifth panel also preferably includes tab slots formed proximate the respective ends thereof and extending between the opposing sides thereof.

The sixth panel typically includes four sides and a tab carried along one side thereof. This sixth panel may also include a pin receptacle formed therein proximate the tab for selectively receiving a pin carried by one of the third panels. This sixth panel may have a notch for being selectively interengaged by a hook attached to a respective third panel.

DETAILED DESCRIPTION OF PREFERRED EMBODIMENTS

Other objects, features and advantages will occur from the following description of a preferred embodiment and the accompanying drawings, in which.

Figure 1:
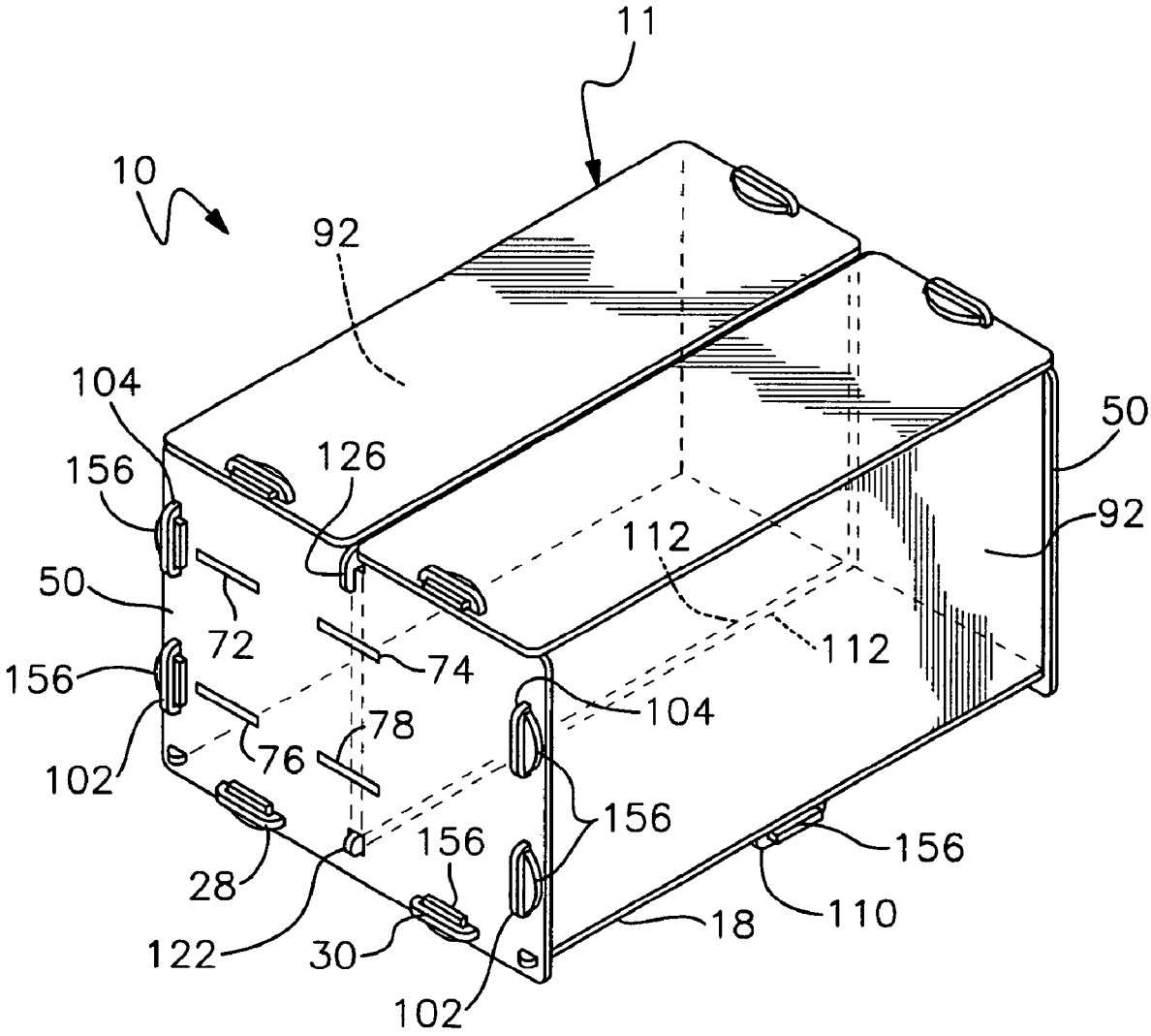
FIG. 1 is a perspective view of the convertible assembly of this invention with the components assembled in a first pattern of interlocking interengagement to define a storage box.

There is shown in FIG. 1 a convertible storage box assembly 10, which comprises a plurality of releasably interengaged and interlocked panels depicted individually in FIGS. 3-8. Box 10 is utilized to conveniently organize, store and transport various types of items such as camping gear. The variety of items that may be stored in box 10 is virtually unlimited. As desired, box 10 may be disassembled, in the manner described more fully below, and the components re-assembled, in the manner shown in FIG. 2, to form a table 12 and associated benches 14 and 16. The assembly can be converted quickly and conveniently, as required, between the box shown in FIG. 1 and the table and benches shown in FIG. 2 because the individual panel components utilized in the assembly carry reliable and easy to use locking components. These components are readily interengagable with one another in a pair of alternative patterns to assemble the respective products.

Assembly 10 comprises a plurality of panels shown individually in FIGS. 3-8. The panels are assembled in either of two alternate patterns or configurations to form either box 11 or table 12 and benches 14, 16 respectively. In particular, the assembly includes a first panel 18, which is shown alone in FIG. 3. Panel 18 is utilized to selectively form the bottom of box 11, FIG. 1 or the tabletop of table 12, FIG. 2. Panel 18 has a generally rectangular shape with a pair of opposing ends 20, 22, and a pair of opposing sides 24 and 26 that interconnect the ends.

As with the other panel components of this invention, panel 18 includes a plurality of interlocking components that are designed to releasably interengage and lock with complementary components formed on other panels of the assembly. In particular, panel 18 includes a first pair of locking tabs 28 and 30 that are formed unitarily with panel 18 and project from end 20. A similar pair of locking tabs 32 and 34 are formed along and project from end 22. The locking tabs are designed to be received by complementary locking tab slots in other panels of the assembly when the panels are assembled in a selected manner. Each of the locking tabs includes an elongate slot 36, which receives a locking pin when panel 18 is interengaged with other panels of the assembly in a manner described below.

Panel 18, as well as the other panel components of this invention, may be constructed of various materials including plastic, wood, wood composite, laminates, metal alloys, etc. Preferably, durable and yet lightweight materials are utilized. The particular material comprising the panels is not a limitation of this invention. The size and thickness of each of the panels in the assembly may also be varied somewhat within the scope of this invention.

Panel 18 also carries four unitary locking pins 38, 40, 42 and 44 that project from the ends 20 and 22 of the panel proximate respective corners of the panel. These locking pins releasably interengage complementary pin slots described below, which are formed in other panel components of the invention. A pair of tab slots 46 and 48 are formed through panel 18 along sides 26 and 24, respectively. These tab slots are designed to receive locking tabs carried by other panels of the assembly. Once again, this interengagement is described more fully below.

Figure 2:
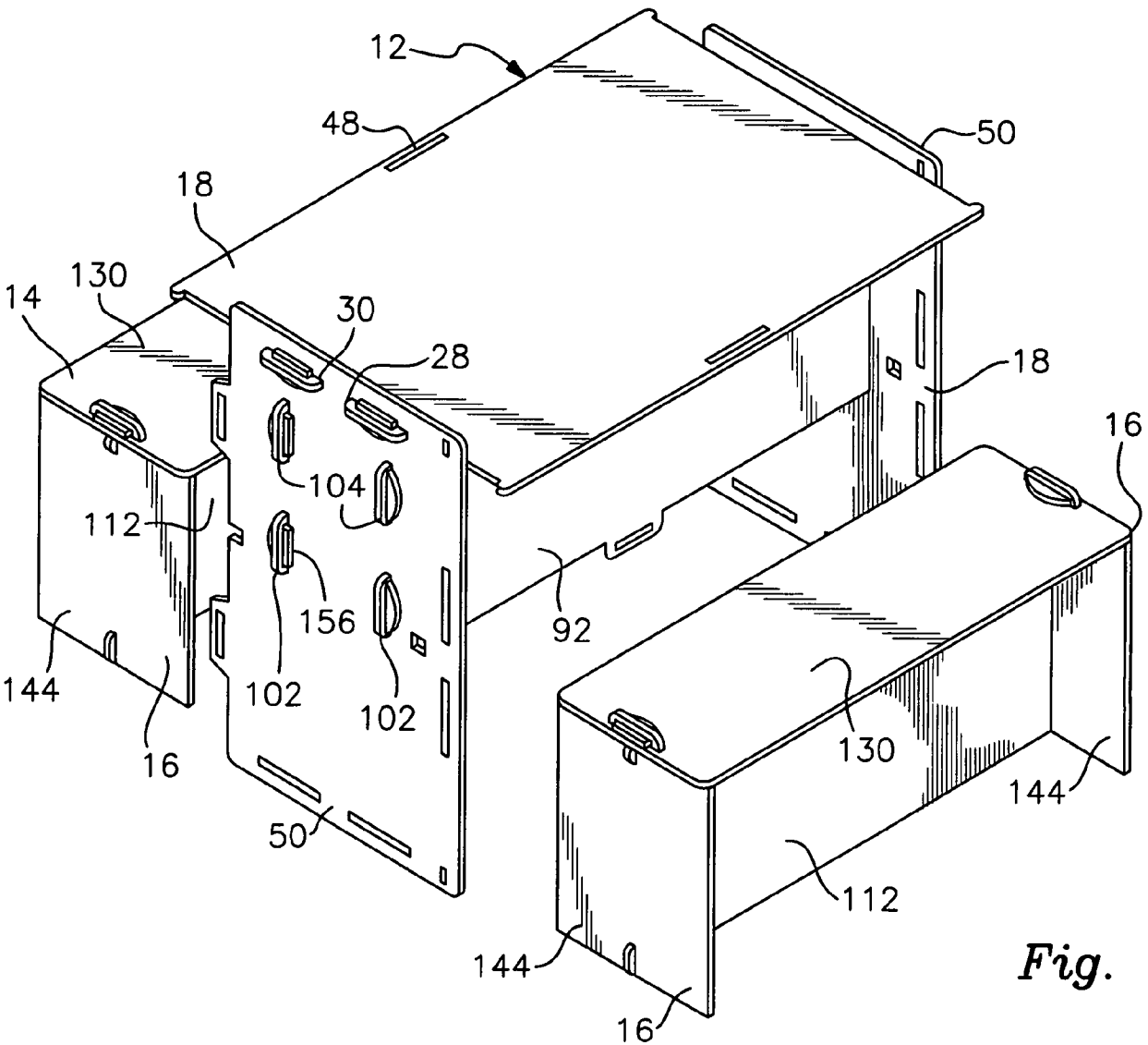
FIG. 2 is a perspective view of the assembly with the components interengaged and interlocked in an alternate second pattern to define a table and a pair of associated benches.
Figure 4:
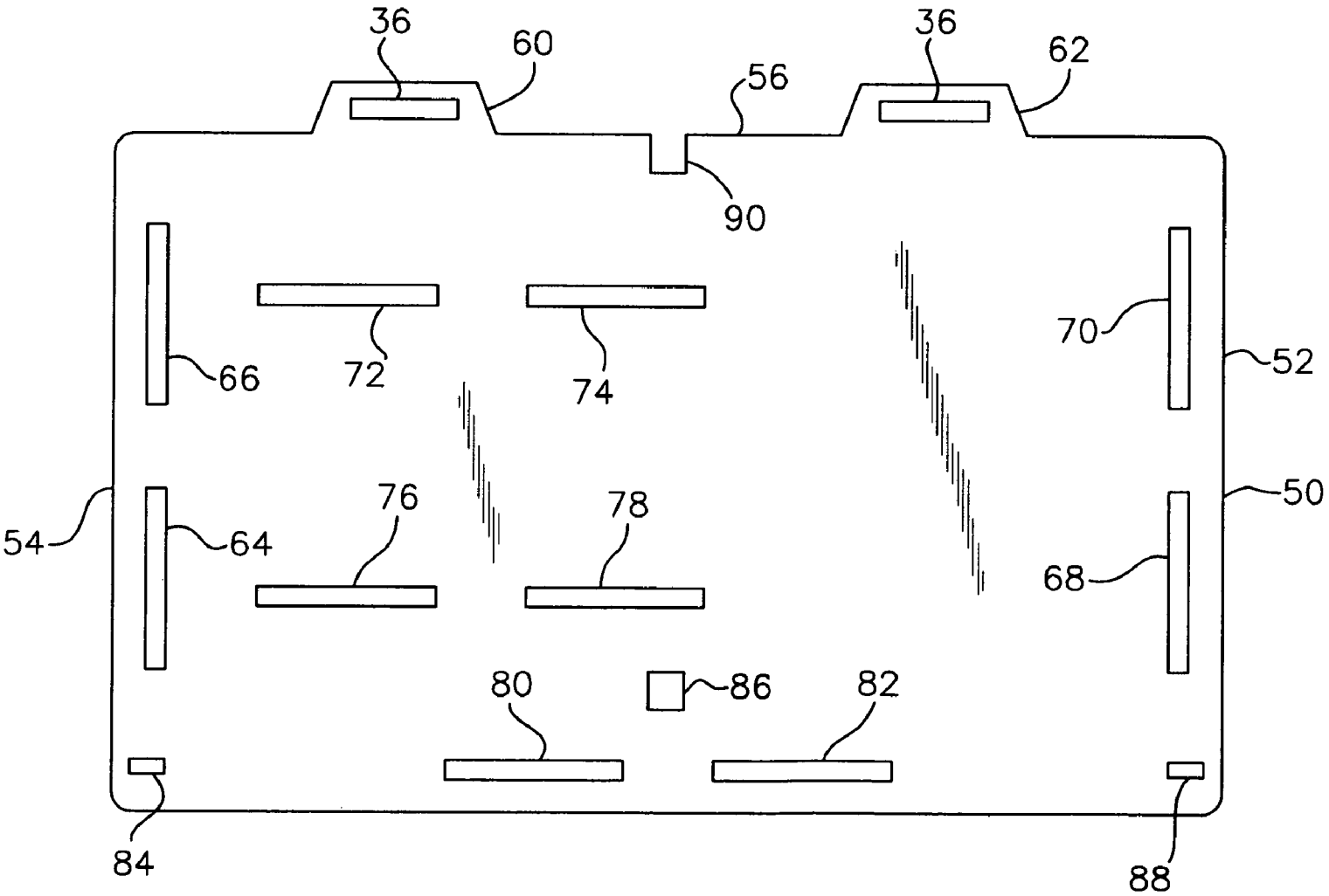
FIG. 4 is an elevational plan view of a representative one of the second panels, which selectively forms either an end of the box or an end of the table.

A pair of like second panels 50 are provided for selectively forming respective ends of box 11, FIG. 1 and respective ends of table 12, FIG. 2. A representative panel 50 is illustrated in FIG. 4. This panel includes a generally rectangular shape and specifically features a pair of relatively short opposing ends 52 and 54, as well as pair of relatively long opposing sides 56 and 58 that interconnect ends 52 and 54. The locking components carried by panel 50 include a pair of spaced apart locking tabs 60 and 62 that are attached unitarily to and project from side 56 of panel 50. Once again, each locking tab includes an elongate slot 36. As with panel 18, each locking tab 60, 62 of panel 50 is intended to interengage a complementary locking slot formed in another panel of the assembly.

A number of elongate locking slots are also formed through panel 50. In particular, a first pair of aligned tab slots 64 and 66 extend transversely across the panel between sides 56 and 58. Slots 64 and 66 are formed proximate end 54 of panel 50. Similarly, a second pair of aligned locking tab slots 68 and 70 extend transversely across panel 50 between sides 56 and 58 but proximate end 52. Another pair of aligned slots 72 and 74 extend longitudinally on panel 50 between ends 52 and 54. By the same token, a second pair of longitudinal slots 76 and 78 are formed in panel 50 generally parallel to slots 72 and 74. A third pair of aligned longitudinal slots 80 and 82 are formed in panel 50 proximate side 58. Three locking pin slots 84, 86 and 88 are formed through panel 50 in the manner shown. The locking tab slots and pin slots receive complementary tabs and pins in the manner described below in order to assemble the panels 50 of the assembly into the alternate configurations of this invention.

A generally rectangular notch 90 is formed in side 56 of panel 50 between tabs 60 and 62. This notch is designed to be selectively interengaged by complementary locking hooks carried by the panel shown in FIG. 6 when the panels are assembled into the box 11 illustrated in FIG. 1. This form of interengagement is described more fully below.

As further shown in FIGS. 1 and 2, a pair of like third panels 92 are utilized for selectively forming respective sides of box 11, FIG. 1, and respective underlying supports for tabletop 18, FIG. 2. In FIG. 2, only one panel 92 is shown beneath the tabletop 18 and behind the end panel 50. The other panel 92 is parallel to the panel shown and interconnects end panels 50 at locations spaced apart from the locations at which depicted panel 92 interconnects panels 50.

Figure 5:
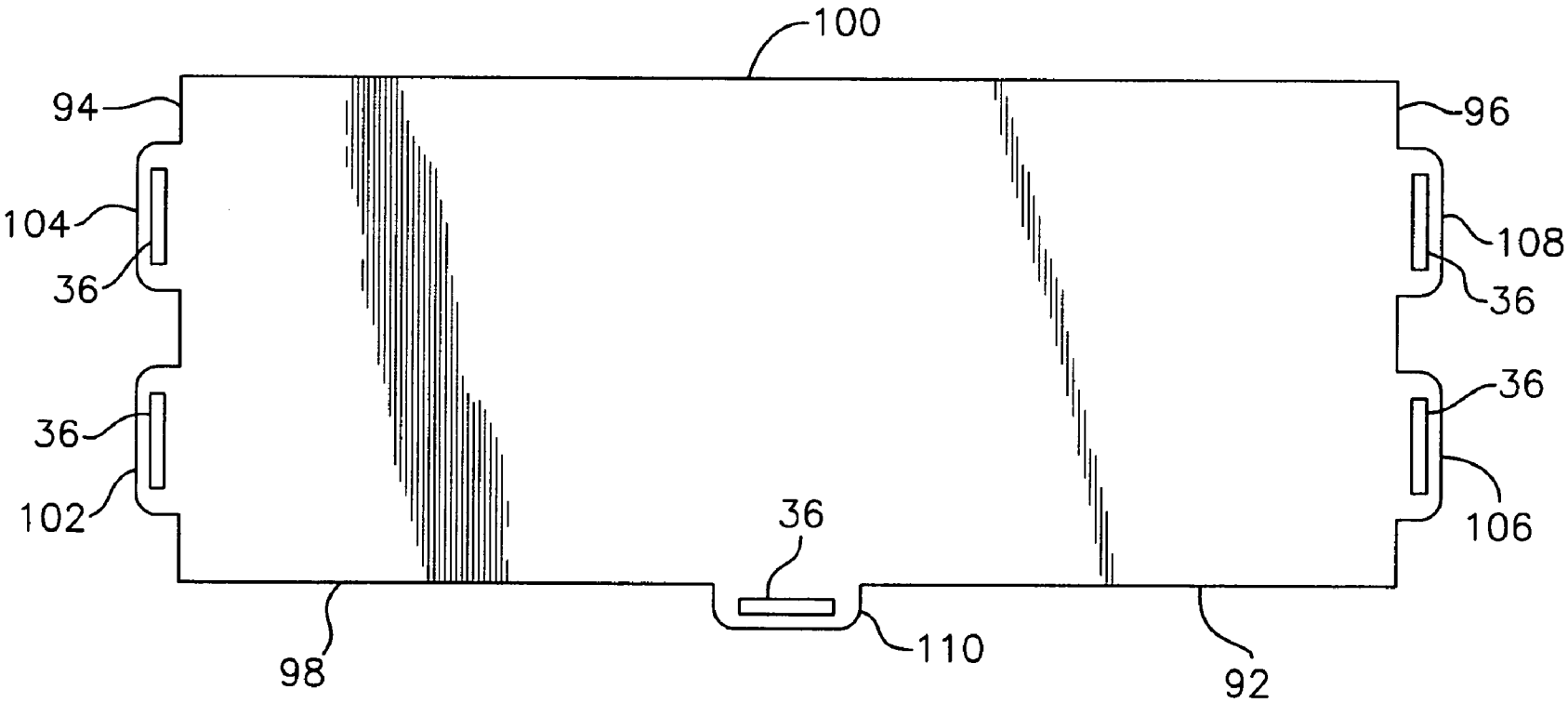
FIG. 5 is a front elevational view of a representative one of the third panels, which selectively forms either a side of the box or a table support.

A representative panel 92 is shown in FIG. 5. Once again, each panel 92 has a generally rectangular shape. There are relatively short opposing ends 94 and 96 and a pair of relatively long sides 98 and 100 that interconnect the ends. A first pair of unitary locking tabs 102 and 104 project from end 94. A second pair of unitary locking tabs 106 and 108 project from end 96. Each such locking tab features an elongate slot 36. Panel 92 also features a fifth locking tab 110 that is attached unitarily to and projects from side 98 of panel 92. Tab 110 also includes an elongate slot 36. As with the other panels, the locking tabs carried by panel 92 are designed to releasably interengage locking tab slots formed in other panel components of assembly 10.

Figure 6:
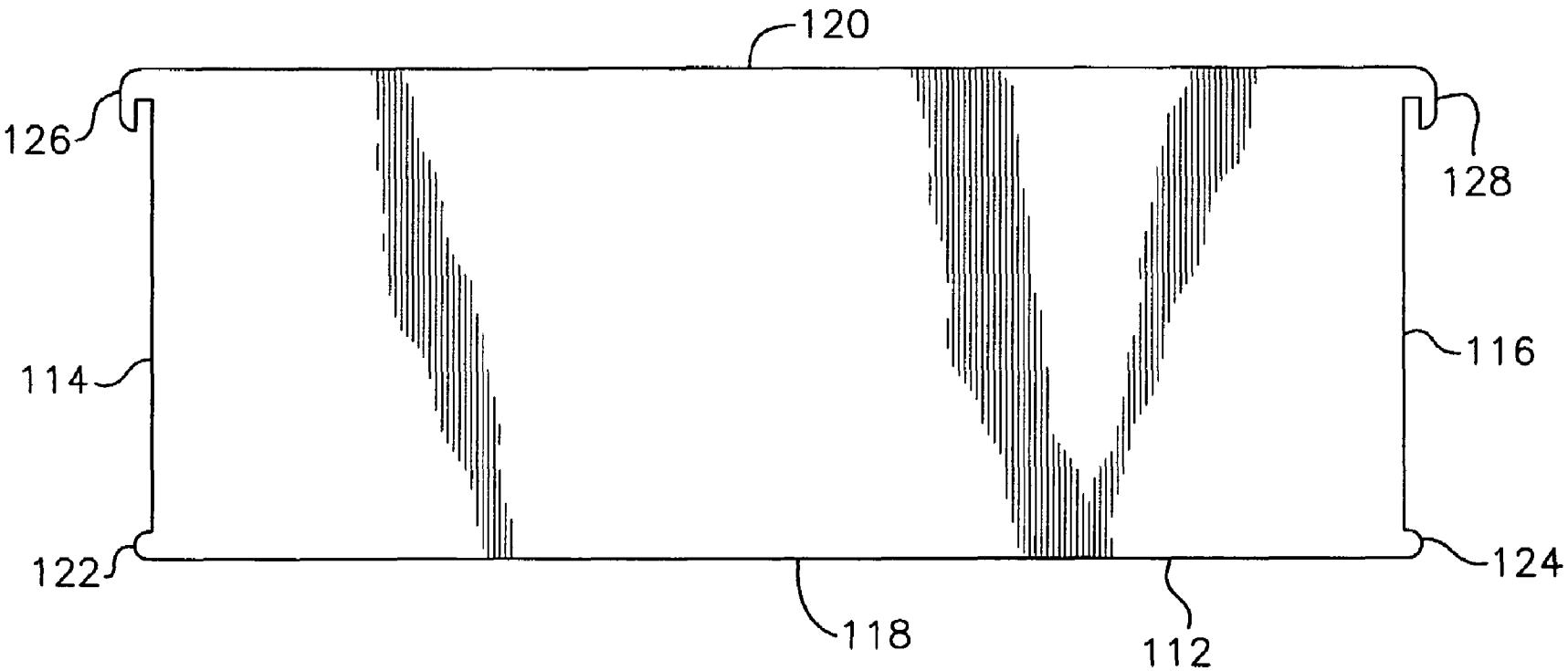
FIG. 6 is a front elevational view of a representative one of the fourth panels, which selectively forms either a box divider or a bench support.

A pair of like fourth panel components 112 are provided for selectively forming an interior box divider, FIG. 1, and respective bench seat supports, FIG. 2. A representative panel 112 is shown in FIG. 6. As with the other panels, panel 112 has a generally rectangular shape. There are relatively short opposing ends 114 and 116, which are interconnected by relatively long sides 118 and 120. A pair of locking pins 122 and 124 are attached unitarily to panel 112 and project from opposite ends 114 and 116 proximate the respective corners that those ends form with side 118. A first locking hook 126 projects unitarily from end 114 proximate the corner that end forms with side 120. A second locking hook 128 likewise projects unitarily from the end 116 proximate the corner that end makes with side 120. The hooks and pins of each panel 112 are selectively interengaged with complementary locking components in the manner described below in order to alternately form the assemblies of FIGS. 1 and 2.

Figure 7:
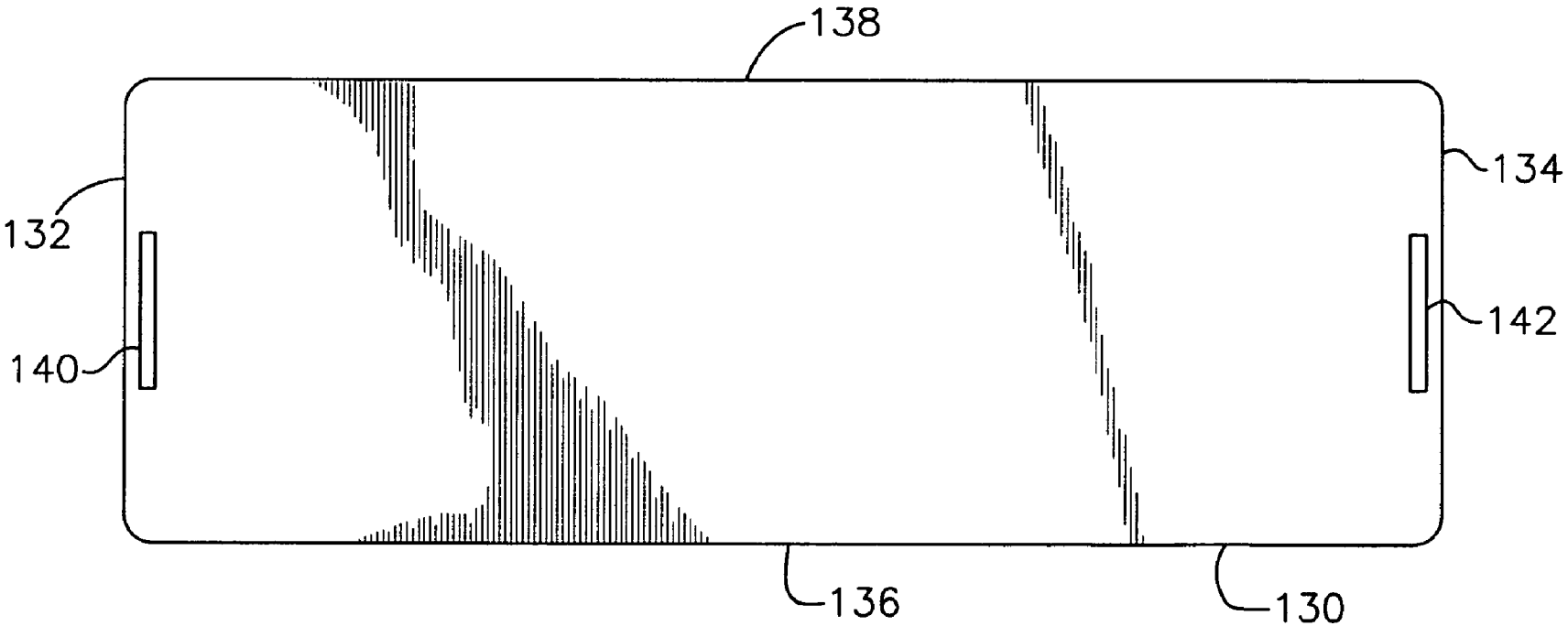
FIG. 7 is a plan view of a representative one of the fifth panels, which selectively forms either a lid of the box or a bench seat.

Assembly 10 further features a pair of like fifth panels 130 for selectively forming respective lids of box 11, as shown in FIG. 1, and respective bench seats, as shown in FIG. 2. A representative panel 130 is illustrated in FIG. 7. That panel has a rectangular shape with a pair of relatively short opposing ends 132 and 134 interconnected by a relatively long opposing sides 136 and 138. A first transverse tab slot 140 is formed in panel 130 proximate end 132. A second transverse tab slot 142 is similarly formed in panel 130 proximate end 134. These tab slots releasably receive respective locking tabs of other panels in the assembly in the manner described more fully below.

Figure 8:
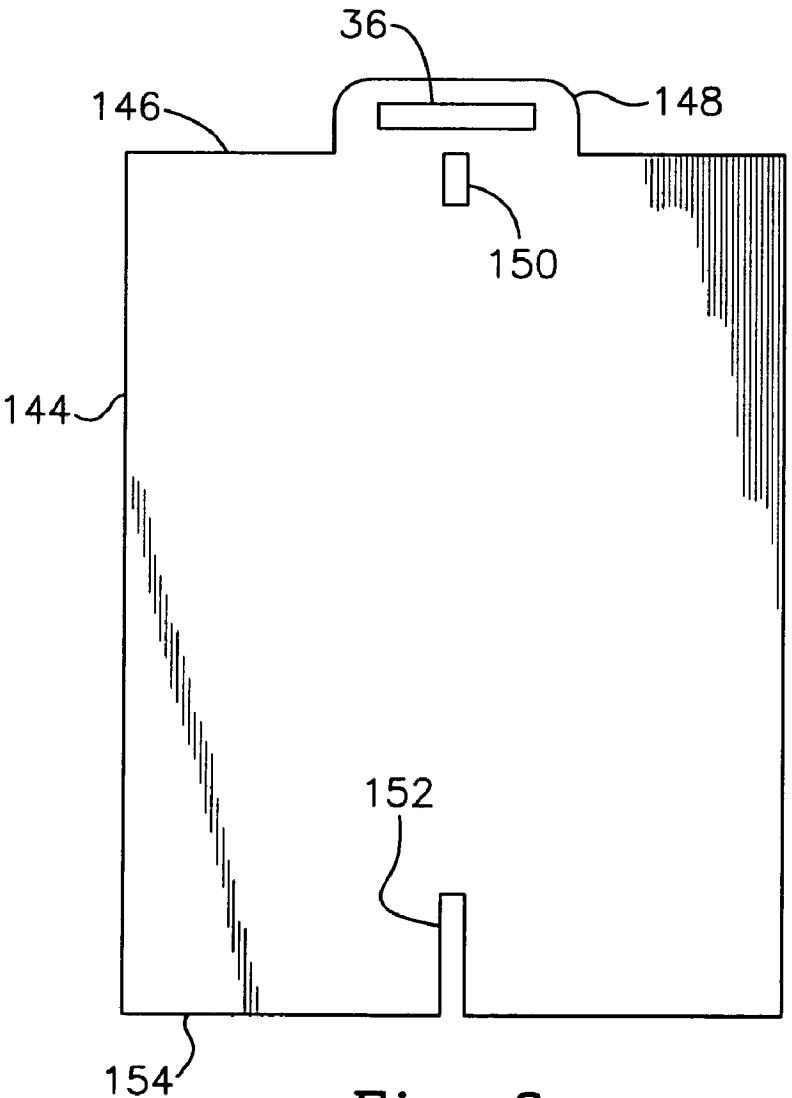
FIG. 8 is a front elevational view of a representative one of the sixth panels, which selectively forms a bench end piece.

Assembly 10 also features also features four like sixth panels 144, a representative one of which is shown in FIG. 8. These panels are utilized, when needed, to form respective end supports of the table benches 14 and 16 shown in FIG. 2. In the version of the assembly wherein box 11 is formed, FIG. 1, the sixth panels 144 are simply stored inside of the assembled box or elsewhere. They do not form a structural component of the box.

As more specifically shown in FIG. 8, each sixth panel 144 has a rectangular shape. An upper end 146 of the panel carries as a unitary locking tab 148 having a longitudinal pin slot 36. The locking tab is analogous to the previously described locking tabs. A locking pin slot 150 is formed slightly below tab 148. A hook engaging notch 152 is formed in the opposite lower end 154 of panel 144.

Figure 9:
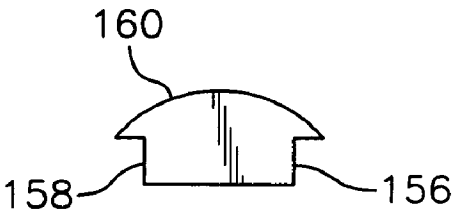
FIG. 9 is a front elevational view of a representative locking pin used to releasably to interlock a tab and a tab slot into which the tab is inserted in accordance with this invention.

FIG. 9 depicts a representative locking pin 156 that is utilized to lock together the interengaged panel components of this invention. In particular, when the assembly is assembled into either of its alternative patterns or configurations, at least some of the locking tabs on certain panels are receivably interengaged by corresponding locking slots on other panels. In such cases, a locking pin 156 is inserted through the elongate slot of the received locking tab. This locks the locking tab in place within the tab slot. More particularly, the lower body 158 of pin 156 is inserted into a respective slot 36 and the pin is pushed into the pin slot 36 until the head 160 of pin 156 engages the tab. A snug fit should be provided between the pin and the pin slot so that the interengaged tab and tab slot are fastened securely together. At the same time, the pin 156 should be readily disengageable from the pin slot 156 when the head 160 of the pin is grasped and pulled outwardly from the tab. This allows the interengaged tab and tab slot to be disengaged by hand, as needed, so that the assembly can be disassembled and either stored or converted into the alternative assembly. A hammer may be helpful to more snugly fix the locking pins in place; however, such tools are not required to practice the invention.

Assembly of Box 11

Figure 3:
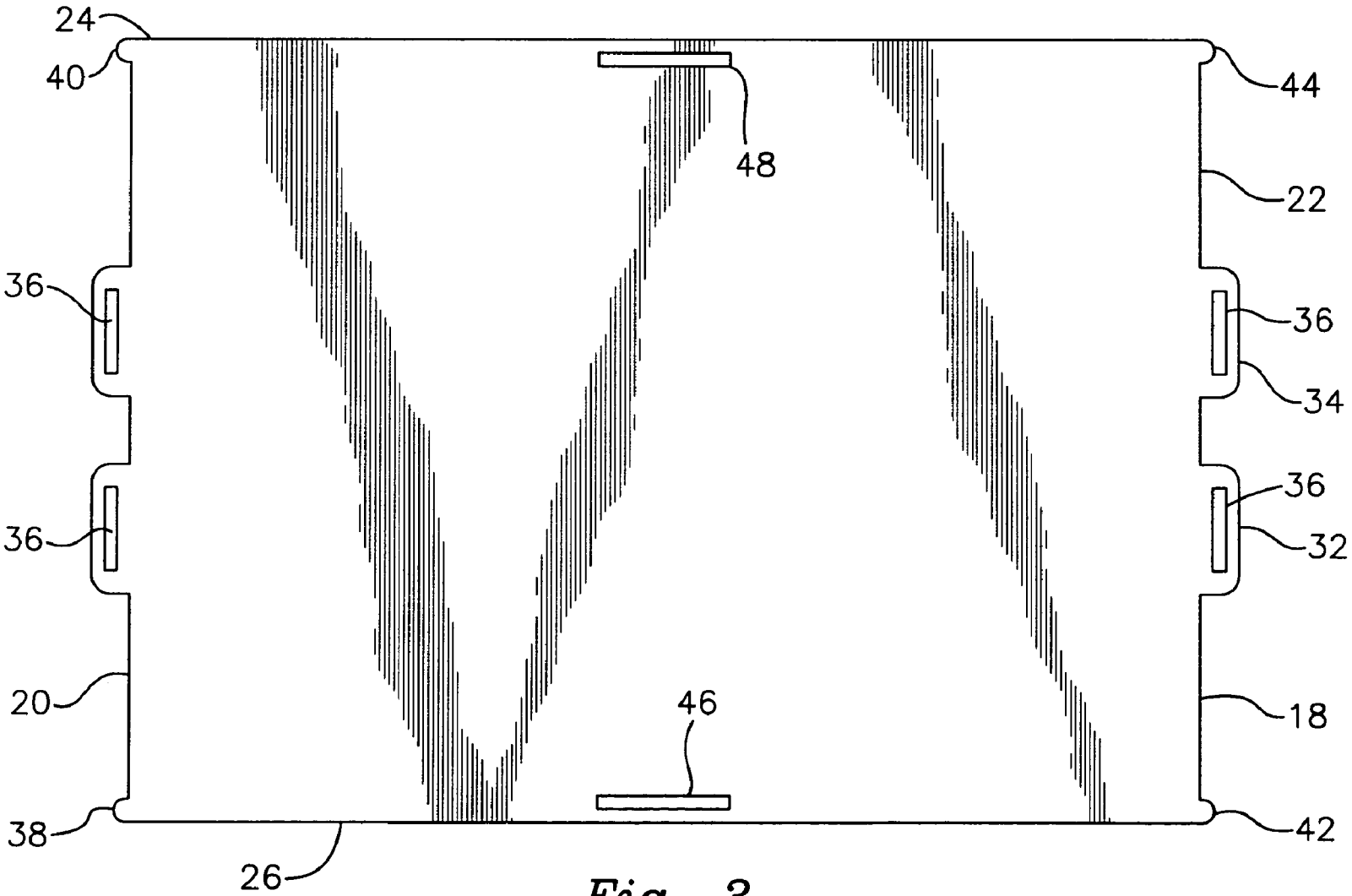
FIG. 3 is a top plan view of the first panel component, which selectively forms the bottom of the box or the top of the table.

Box 11, shown in FIG. 1, may be assembled in the following manner. Panel 18, FIG. 3, is first placed on a table, floor or other generally flat surface. One of panels 92, FIG. 5, is arranged so that its tab 110 is aligned with slot 46 of panel 18. Tab 110 is then inserted into slot 46 and a locking pin 156, FIG. 9, is inserted through the pin slot 36 of tab 110, see FIG. 1. This procedure is then repeated for the other panel 92 along the opposite side 24 of panel 18. In particular, the tab 110 of the second panel 92 is inserted through the tab slot 48 of panel 18. A locking pin is interengaged with the slot 36 of the second side panel's lower tab. As a result, both side panels are joined to the bottom panel.

Next, one of the box end panels 50, FIG. 4, is interengaged with bottom panel 18 and side panels 92. End tabs 28 and 30 of bottom panel 18 are inserted through tab slots 80 and 82 respectively of one end panel 50. At the same time, unitary pins 38 and 40 of bottom panel 18 are received by corresponding pin slots 84 and 88 in end panel 50. The end tabs 102 and 104 of one of the side panels 92 are likewise inserted respectively through tab slots 68 and 70 of panel 50; and the tabs 102 and 104 of the other side panel 92 are similarly inserted through tab slots 64 and 66 of panel 50. Locking pins 156 are then inserted into the pin slots 36 of bottom tabs 28 and 30. After these steps have been completed, the opposite end of box end panel 50 is interengaged with the opposite end 22 of bottom panel 18, as well as the opposite ends of the respective side panels 92, in an analogous manner. When the opposite end panel is engaged in this manner, the locking tabs 32 and 34 are received by the slots 80 and 82 of that end panel; similarly, pins 42 and 44 of bottom panel 18, are received by pin slots 84, 88 in the opposite end panel.

After the bottom, ends and sides of the box are assembled in the foregoing manner, one of the box divider panels 112, FIG. 6, is introduced between box end panels 50. Side 118 of panel 112 is positioned along the upper surface of bottom panel 18 such that pins 122 and 124 are aligned with corresponding pin slots 86 in respective end panels 50. Pins 122 and 124 are respectively interengaged with pin slots 86 and hooks 126 and 128 of panel 112 are interengaged with respective notches 90 on end panels 50. The other divider panel 112 is interengaged with the opposing end panels 50 in a similar manner. It should be understood that notches 90 and pin slots 86 are wide enough to accommodate a pair of hooks and a pair of pins respectively.

After the divider panels are inserted, locking pins 156 are inserted into the pin slots of end tabs 102, 104, 106 and 108 of each side panel 92. After the bottom, sides and ends of the box, as well as the box dividers are assembled in the foregoing manner, the sixth panels 144, FIG. 8, which define the bench end supports, are stored within the assembled box. In the box embodiment, these bench supports are not required. Accordingly, two panels 144 may be placed in each compartment defined by the dividers within the assembled box 11. Other material, such as camping gear, work equipment, etc. may similarly be stored in a neat and organized manner within the box.

Assembly of the box is completed by engaging lid panels 130, FIG. 7, with the box. In particular, each lid panel is aligned with the top of the box such that the lid slots 140, 142 are aligned respectively with the corresponding locking tabs 60 on spaced end panels 50. Panel 130 is lowered onto the box such that aligned tabs 60 are received by slots 140 and 142 respectively. The second panel 130 is similarly engaged with the box such that the aligned tabs 62 of panels 50 are received respectively through the slots 140, 142 of the second panel 130. Locking pins 156 are then inserted through the locking slots 136 of tab 60 of each panel 50. This locks the lid panels 130 onto the box.

Box 11 may be assembled quickly and conveniently so that its panels can be either stored or re-assembled into the table and bench configuration depicted in FIG. 2. To disassemble box 11, the locking pins 156 are simply pulled out of the locking tab slots. This allows the locking tabs to be easily disengaged from their corresponding locking slots. By the same token, the respective unitary locking pins and pin receptacles are disengaged. Likewise, the hooks of the divider panels are readily disengaged from their corresponding notches. Disassembly of the box is thereby performed quickly and conveniently.

Assembling the Table and Associated Benches

One second panel 50 is held upright such that end 54 engages the floor and slots 68 and 70 are positioned at the upper end of the panel. First panel 18 is interengaged with upright panel 50 by inserting tabs 28 and 30 into slots 68 and 70 respectively. A locking pin 156 is then inserted through the pin slot 136 of each of the tabs 28 and 30. Tabs 32 and 34 carried at the opposite end of panel 18 are similarly engaged with the transverse tab slots formed at the upper end of the other end panel 50. See FIG. 2.

After the tabletop panel 18 is mounted to the end panels 50 in the foregoing manner, the tabletop support panels comprising fourth panels 92 are interengaged with end panels 50. In particular, the left-hand end tabs of one of the panels 92 are interengaged with tab slots 76, 78 of left-hand end panel 50. The left-hand end tabs 102, 104 of the other panel 92 are similarly engaged with end tab slots 72, 74 of left-hand end panel 50. By the same token, the right-hand end tabs 106, 108 of one panel 92 are receivably interengaged with aligned slots 76, 78 in the second end panel 50 whereas the right-hand end tabs 106, 108 of the second side panel 92 are interengaged with the aligned tab slots 72, 74 of the second (right-hand) end panel. In each case, the interengaged tabs and tab slots are locked in place by inserting a removable locking pin 156 through the respective tab slot in the manner previously described and further shown in FIG. 2. As a result, the fully assembled table as shown in FIG. 2 is achieved.

A first one of the benches is constructed by arranging panel 112 such that the hooks 126 and 128 are positioned along the lower edge and face upwardly. One of the bench end support panels 144 is positioned with its notch facing downwardly. That notch is then interengaged with the hook 126 at one end of panel 112. The unitary pin 122 formed at the upper side of panel 122 is inserted into pin receptacle 150 of panel 144. The opposite end panel 144 is similarly interengaged with the opposite end of panel 112. Specifically, notch 152 is interengaged with hook 128 and pin 124 is interengaged with the second panel's pin receptacle 150. The bench is completed by aligning one of the panels 130 with the bench end panels 144 such that tab slots 140 and 142 are aligned with the tabs 148 of respective panels 144. The respective tabs 148 are inserted through corresponding tab slots 140 and 142 and locked in placed by respective pins 156. The foregoing steps are repeated with the remaining two panels 144 to complete the second bench in an analogous fashion.

The table and benches may be assembled and disassembled, as required, in a quick and convenient manner. The interengaged tabs and tab slots are locked together by the releasable locking pins, which are interengaged with the elongate slots in each locking tab. Otherwise, the unitary locking pins are snap-fit, in a quick and easy yet secure manner, into the respective pin receptacles. Similarly, the complementary hooks and notches are quickly and conveniently interengaged and disengaged as required. The assembly requires a minimal number of pieces and parts and, in most cases, eliminates the need for tools to complete the assembly. Both the storage box and the table/bench assemblies may be constructed using simply the six different types of panels described herein and locking pins 156 for interlocking the complementary tabs and tab slots. No other parts and no tools are required.

It should be understood that in alternative versions of this invention, various other interlocking configurations may be employed. For example, the first panel that defines the bottom of the box and the tabletop may be provided with a single locking tab. Likewise, the third panels that form the sides of the box and the tabletop support may feature a single locking tab on each end thereof. In versions wherein single tabs are employed, the second panel, which defines the ends of the box and the ends of the table may include a lesser number of tab slots to accommodate the single slots utilized by the first and third panels.

The convertible assembly of this invention is extremely easy to use, disassemble and re-assemble. It is especially useful in applications where a storage box or container is required to transport items to a remote site and wherein, on occasion, a table and associated benches are needed at that site. Applications wherein use of the convertible assembly is particularly advantageous include camping for example. In situations where the camper is traveling to a remote location where tables and benches are not available or accessible, the invention is particularly handy. During transit, the assembly is assembled into the storage box, shown in FIG. 1, so that camping gear and other items can be transported to the site neatly and in an organized fashion. Then, when the camper arrives at the site, the storage box can be disassembled and re-assembled into a table and associated benches which may be conveniently used for dining or other tasks.

The assembly is also particularly useful for work applications. The storage box is convenient for transporting tools or other work gear. At the work site, the box can be reassembled into a work bench, saw horse apparatus or similar work structure. The assembly eliminates the need to transport separate storage boxes, work tables and benches which are all quite bulky. Space and efficiency are therefore improved considerably.

From the foregoing it may be seen that the apparatus of this invention provides for a convertible storage box and, more particularly, to a box comprising parts that may be disassembled and re-assembled to form a table and benches. While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

Other embodiments will occur to those skilled in the art and are within the following

What is claimed is:

1. A multiple panel assembly that is convertible between a storage box and a table and associated pair of benches, said assembly comprising:

a first panel for selectively forming a bottom of the box and a top of the table;

an identically shaped pair of second panels for selectively forming respective ends of the box and respective ends of the table;

an identically shaped pair of third panels for selectively forming respective sides of the box and respective table supports;

an identically shaped pair of fourth panels for selectively forming an interior box divider and respective bench seat supports;

an identically shaped pair of fifth panels for selectively forming respective lids of the box and respective bench seats; and four identically shaped sixth panels for selectively forming respective bench ends; said panels carrying a plurality of releasable locking components that are selectively interengagable with said panels arranged in a first predetermined pattern to define a storage box and with said panels arranged in an alternative second predetermined pattern to define a table and a pair of associated benches, said releasable locking components including tabs attached to at least some of said panels and complementary tab slots formed in at least some of said other panels, each tab slot for selectively receiving a respective said tab, at least one of tabs including a pin slot for receiving a locking pin therein when said tab is received by a complementary tab slot to lock said tab in said tab slot.

2. A multiple panel assembly that is convertible between a storage box and a table and associated pair of benches, said assembly comprising:

a first panel for selectively forming a bottom of the box and a top of the table;

an identically shaped pair of second panels for selectively forming respective ends of the box and respective ends of the table;

an identically shaped pair of third panels for selectively forming respective sides of the box and respective table supports;

an identically shaped pair of fourth panels for selectively forming an interior box divider and respective bench seat supports;

an identically shaped pair of fifth panels for selectively forming respective lids of the box and respective bench seats; and four identically shaped sixth panels for selectively forming respective bench ends; said panels carrying a plurality of releasable locking components that are selectively interengagable with said panels arranged in a first predetermined pattern to define a storage box and with said panels arranged in an alternative second predetermined pattern to define a table and a pair of associated benches, said releasable locking components including tabs attached to at least some of said panels and complementary tab slots formed in at least some of said other panels, each tab slot for selectively receiving a respective said tab, said releasable locking components including a pin attached unitarily to one of said panels and a complementary pin receptacle formed in another one of said other panels for receiving said pin.

3. The assembly of claim 2 in which said first panel includes a first pair of said unitary pins attached to a first end thereof and a second pair of said unitary pins attached to an opposite end thereof.

4. The assembly of claim 2 in which said second panel includes three pin receptacles, two for selectively receiving respective unitary locking pins carried by said first panel and the other said pin receptacle for selectively receiving a unitary locking pin carried by said fourth panel.

5. The assembly of claim 2 in which said fourth panel includes a pair of unitary locking pins attached to respective ends of said fourth panel for being selectively interengaged with respective pin receptacles formed in one of said second panels and one of said sixth panels.

6. The assembly of claim 2 in which said sixth panel includes a pin receptacle formed therein for selectively receiving a unitary locking pin carried by said fourth panel.

7. A multiple panel assembly that is convertible between a storage box and a table and associated pair of benches, said assembly comprising:

a first panel for selectively forming a bottom of the box and a top of the table;

an identically shaped pair of second panels for selectively forming respective ends of the box and respective ends of the table;

an identically shaped pair of third panels for selectively forming respective sides of the box and respective table supports;

an identically shaped pair of fourth panels for selectively forming an interior box divider and respective bench seat supports;

an identically shaped pair of fifth panels for selectively forming respective lids of the box and respective bench seats; and four identically shaped sixth panels for selectively forming respective bench ends; said panels carrying a plurality of releasable locking components that are selectively interengagable with said panels arranged in a first predetermined pattern to define a storage box and with said panels arranged in an alternative second predetermined pattern to define a table and a pair of associated benches, said releasable locking components including tabs attached to at least some of said panels and complementary tab slots formed in at least some of said other panels, each tab slot for selectively receiving a respective said tab, said releasable locking components including a hook attached unitarily to one of said panels and a complementary notched formed in another one of said other panels for selectively interengaging said hook.

8. The assembly of claim 7 in which said second panel includes a notch for being selectively interengaged by a hook attached to a respective said third panel.

9. The assembly of claim 7 in which said sixth panel includes a notch for being selectively interengaged by a hook attached to a respective said fourth panel.

10. A multiple panel assembly that is convertible between a storage box and a table and associated pair of benches, said assembly comprising:

a first panel for selectively forming a bottom of the box and a top of the table;

an identically shaped pair of second panels for selectively forming respective ends of the box and respective ends of the table;

an identically shaped pair of third panels for selectively forming respective sides of the box and respective table supports;

an identically shaped pair of fourth panels for selectively forming an interior box divider and respective bench seat supports;

an identically shaped pair of fifth panels for selectively forming respective lids of the box and respective bench seats; and four identically shaped sixth panels for selectively forming respective bench ends; said panels carrying a plurality of releasable locking components that are selectively interengagable with said panels arranged in a first predetermined pattern to define a storage box and with said panels arranged in an alternative second predetermined pattern to define a table and a pair of associated benches, said releasable locking components including tabs attached to at least some of said panels and complementary tab slots formed in at least some of said other panels, each tab slot for selectively receiving a respective said tab, said first panel having a first pair of said tabs attached to a first end thereof and a second pair of said tabs attached to an opposite second end thereof.

11. The assembly of claim 10 in which said first panel has a pair of tab slots formed along respective sides thereof, which sides interconnect the opposing ends.

12. A multiple panel assembly that is convertible between a storage box and a table and associated pair of benches, said assembly comprising:

a first panel for selectively forming a bottom of the box and a top of the table;

an identically shaped pair of second panels for selectively forming respective ends of the box and respective ends of the table;

an identically shaped pair of third panels for selectively forming respective sides of the box and respective table supports;

an identically shaped pair of fourth panels for selectively forming an interior box divider and respective bench seat supports;

an identically shaped pair of fifth panels for selectively forming respective lids of the box and respective bench seats; and four identically shaped sixth panels for selectively forming respective bench ends; said panels carrying a plurality of releasable locking components that are selectively interengagable with said panels arranged in a first predetermined pattern to define a storage box and with said panels arranged in an alternative second predetermined pattern to define a table and a pair of associated benches, said releasable locking components including tabs attached to at least some of said panels and complementary tab slots formed in at least some of said other panels, each tab slot for selectively receiving a respective said tab, said second panel including a pair of said tabs attached to one side thereof.

13. A multiple panel assembly that is convertible between a storage box and a table and associated pair of benches, said assembly comprising:

a first panel for selectively forming a bottom of the box and a top of the table;

an identically shaped pair of second panels for selectively forming respective ends of the box and respective ends of the table;

an identically shaped pair of third panels for selectively forming respective sides of the box and respective table supports;

an identically shaped pair of fourth panels for selectively forming an interior box divider and respective bench seat supports;

an identically shaped pair of fifth panels for selectively forming respective lids of the box and respective bench seats; and four identically shaped sixth panels for selectively forming respective bench ends; said panels carrying a plurality of releasable locking components that are selectively interengagable with said panels arranged in a first predetermined pattern to define a storage box and with said panels arranged in an alternative second predetermined pattern to define a table and a pair of associated benches, said releasable locking components including tabs attached to at least some of said panels and complementary tab slots formed in at least some of said other panels, each tab slot for selectively receiving a respective said tab, said second panel including pair of opposing ends and a pair of opposing elongate sides that interconnect said opposing ends, said second panel further including a first plurality of elongate tab slots that extend longitudinally between said ends of said second panel and a second plurality of elongate tab slots that extend longitudinally between said sides of said panel.

14. A multiple panel assembly that is convertible between a storage box and a table and associated pair of benches, said assembly comprising:

a first panel for selectively forming a bottom of the box and a top of the table;

an identically shaped pair of second panels for selectively forming respective ends of the box and respective ends of the table;

an identically shaped pair of third panels for selectively forming respective sides of the box and respective table supports;

an identically shaped pair of fourth panels for selectively forming an interior box divider and respective bench seat supports;

an identically shaped pair of fifth panels for selectively forming respective lids of the box and respective bench seats; and four identically shaped sixth panels for selectively forming respective bench ends; said panels carrying a plurality of releasable locking components that are selectively interengagable with said panels arranged in a first predetermined pattern to define a storage box and with said panels arranged in an alternative second predetermined pattern to define a table and a pair of associated benches, said releasable locking components including tabs attached to at least some of said panels and complementary tab slots formed in at least some of said other panels, each tab slot for selectively receiving a respective said tab, said third panel including a pair of opposing ends and a pair of opposing elongate sides that interconnect said ends, said third panels carrying at least one said tab on each end thereof and at least one tab on one said of the sides thereof.

15. A multiple panel assembly that is convertible between a storage box and a table and associated pair of benches, said assembly comprising:

a first panel for selectively forming a bottom of the box and a top of the table;

an identically shaped pair of second panels for selectively forming respective ends of the box and respective ends of the table;

an identically shaped pair of third panels for selectively forming respective sides of the box and respective table supports;

an identically shaped pair of fourth panels for selectively forming an interior box divider and respective bench seat supports;

an identically shaped pair of fifth panels for selectively forming respective lids of the box and respective bench seats; and four identically shaped sixth panels for selectively forming respective bench ends; said panels carrying a plurality of releasable locking components that are selectively interengagable with said panels arranged in a first predetermined pattern to define a storage box and with said panels arranged in an alternative second predetermined pattern to define a table and a pair of associated benches, said releasable locking components including tabs attached to at least some of said panels and complementary tab slots formed in at least some of said other panels, each tab slot for selectively receiving a respective said tab, said fifth panel including a pair of opposing ends and a pair of opposing elongate sides that interconnect said ends, said fifth panels further including said tab slots formed proximate said respective ends thereof and extending between said opposing sides thereof.

16. A multiple panel assembly that is convertible between a storage box and a table and associated pair of benches, said assembly comprising:

a first panel for selectively forming a bottom of the box and a top of the table;

an identically shaped pair of second panels for selectively forming respective ends of the box and respective ends of the table;

an identically shaped pair of third panels for selectively forming respective sides of the box and respective table supports;

an identically shaped pair of fourth panels for selectively forming an interior box divider and respective bench seat supports;

an identically shaped pair of fifth panels for selectively forming respective lids of the box and respective bench seats; and four identically shaped sixth panels for selectively forming respective bench ends; said panels carrying a plurality of releasable locking components that are selectively interengagable with said panels arranged in a first predetermined pattern to define a storage box and with said panels arranged in an alternative second predetermined pattern to define a table and a pair of associated benches, said releasable locking components including tabs attached to at least some of said panels and complementary tab slots formed in at least some of said other panels, each tab slot for selectively receiving a respective said tab, said sixth panel including a tab carried along one side thereof.

* * * * *